US005488905A

United States Patent [19]

Secor

[11] Patent Number: 5,488,905

[45] Date of Patent: Feb. 6, 1996

[54] AIR-DAM FOR PRINTING PRESS VACUUM TRANSFER APPARATUS

[75] Inventor: Howard W. Secor, Coppell, Tex.

[73] Assignee: Howard W. DeMoore, Dallas, Tex.

[21] Appl. No.: 419,108

[22] Filed: Apr. 10, 1995

[51] Int. Cl.[6] ..... B41F 5/00

[52] U.S. Cl. ..... 101/420; 101/232; 101/183

[58] Field of Search ..... 101/137, 142, 101/177, 183, 232, 492; 271/194, 276

[56] References Cited

U.S. PATENT DOCUMENTS

| | | | |
|---|---|---|---|
| 3,791,644 | 2/1974 | DeMoore | 101/422 |
| 4,572,071 | 2/1986 | Cappel et al. | 101/183 |
| 4,830,355 | 5/1989 | Jeschke | 271/183 |
| 4,997,178 | 3/1991 | Ogoda | 271/276 |
| 5,103,733 | 4/1992 | Drapatsky et al. | 101/232 |
| 5,127,329 | 7/1992 | DeMoore et al. | 101/420 |
| 5,133,255 | 7/1992 | DeMoore et al. | 101/420 |
| 5,205,217 | 4/1993 | DeMoore et al. | 101/420 |
| 5,228,391 | 7/1993 | DeMoore et al. | 101/420 |
| 5,243,909 | 9/1993 | DeMoore et al. | 101/420 |
| 5,419,254 | 5/1995 | DeMoor et al. | 101/420 |

*Primary Examiner*—Eugene H. Eickholt
*Attorney, Agent, or Firm*—Dennis T. Griggs

[57] ABSTRACT

A vacuum-type sheet transfer apparatus for a rotary printing press includes an air dam device formed by an elongated plate which is supported on the transfer apparatus housing and extends toward the surface of a transfer cylinder or impression cylinder of the press. Spaced apart openings are formed in the plate and have deflectable elastomeric flaps disposed in the openings to allow the cylinder gripper fingers to pass by the plate. An air dam or seal is formed by the plate to redirect the flow of air to urge sheets, including lightweight and heavy weight stock, to follow a preferred transfer path between the impression cylinder and the vacuum transfer apparatus.

20 Claims, 4 Drawing Sheets

AIR-DAM FOR PRINTING PRESS VACUUM TRANSFER APPARATUS

FIELD OF THE INVENTION

This invention relates to an air dam or seal for controlling the movement of printed sheets along a transfer path between an impression cylinder and a vacuum sheet transfer apparatus of a printing press.

BACKGROUND OF THE INVENTION

It has been traditional in the art of sheet-fed printing presses to provide apparatus for supporting freshly printed sheets when transferring the sheets from one printing unit to another or when transferring the sheets from the last printing unit to a delivery sheet stacker where the sheets are stacked. Typically, a sheet transfer apparatus may be disposed between the printing units in the press and function to receive a freshly printed sheet from one impression cylinder and transfer the sheet to the next printing unit or to a sheet delivery stacker.

In sheet-fed rotary offset printing presses, for example, it is customary to transfer the sheets from the impression cylinder of one printing unit to the impression cylinder of the next unit by one or more coacting transfer cylinders, each of which is provided with grippers for engaging the leading edge of the sheet. These cylinders usually are formed with substantially continuous peripheral surfaces for supporting and controlling the movement of the sheet during its transfer between printing units.

The above described transfer apparatus has proven to be effective for transferring sheets in precise registration, but has a tendency to cause the sheets to be marked or smeared. Marking and/or smearing of a freshly printed sheet often occurs as the sheet is transferred from the impression cylinder and is immediately conveyed along a serpentine or reverse curvilinear path with its wet printed side in direct contact with the surface of the transfer cylinder. Movement of the sheet is usually so fast that the ink does not have time to set before it contacts the next transfer cylinder surface. Consequently, ink accumulates on the transfer cylinder surface and as the next sheet is transferred, it may become marked or smeared by the ink accumulation on the transfer cylinders.

Marking or smearing of the freshly printed side of the sheet is often caused by a fluttering movement of the sheet as it transfers through the above-mentioned curvilinear path from an impression cylinder to a transfer cylinder. At least slight fluttering occurs in the nip region between the impression cylinder surface and the transfer cylinder surface because of the sudden reversal in the direction of movement of the sheet and the resulting inertia forces acting on the sheet as it is pulled by the grippers through the nip region. Moreover, in many instances, the trailing end portion of the wet, printed side of the sheet may be slapped against the transfer cylinder as it is pulled through the nip region. Both the fluttering movement and the tail slap can cause marking or smearing of a freshly printed sheet.

DESCRIPTION OF THE PRIOR ART

One substantial problem inherent in conventional transfer systems which engage and support the freshly printed side of the sheet is that of marking and smearing the freshly applied ink. In the past, efforts to reduce sheet marking and smearing have included employing apparatus, referred to in the trade as skeleton wheels and cylinders, which have sheet engaging surfaces intended to minimize the area of surface contact while providing sheet support. Exemplary of such prior art devices are those discussed in U.S. Pat. 3,791,644 issued Feb. 12, 1974 to Howard W. DeMoore.

An improved transfer system having a cylinder with a specially prepared friction reducing support surface covered by a fabric cloth, known in the trade as a "net" is disclosed and claimed in U.S. Pat. 4,402,267 issued Sept. 6, 1983 also to Howard W. DeMoore. The system, of the '267 patent, which is marketed worldwide under license by Printing Research, Inc. of Dallas, Tex. under its registered trademark "SUPER BLUE", actually minimizes the area of contact between the wet ink side of the sheet and the net covered surface of the transfer cylinder. While the "SUPER BLUE" sheet transfer system has received worldwide industry acceptance and has enjoyed substantial commercial success, it is often necessary after prolonged use to replace the fabric net due to a build-up of ink on the net surface, or as a result of the net becoming excessively worn and/or torn. While the "SUPER BLUE" transfer system allows the fabric net to be replaced relatively quickly, replacement of the net still requires that the press be shut down, at least for a short time.

However, in many sheet printing operations, only one side of the sheet receives ink during each pass through the press unit. Accordingly, in such situations where only one side of the sheet is to be printed, use of a transfer system which engages and supports the printed side of the sheet may be unnecessary and a transfer system which engages and supports only the non-printed side of the sheet is preferable. For example, transfer apparatus has been proposed wherein a stationary curved sheet guide is provided having a solid surface disposed adjacent to the path of the sheet transfer grippers and which supports the non-printed side of a freshly printed sheet as it is pulled by sheet grippers from the impression cylinder. A vacuum pressure differential is created between the sheet and the surface of the sheet guide apparatus so that the sheet is drawn into engagement with the sheet guide.

It has also been suggested to employ a stationary curved sheet guide having an apertured support surface through which air can be drawn to create a negative pressure differential or vacuum force acting on the sheet, thereby to draw the non-printed side of the sheet gently against the sheet guide. In this latter arrangement, the sheet guide may be formed as the surface of a plenum coupled to a plurality of fans which can be selectively operated to either provide a negative pressure or partial vacuum within the plenum chamber, or a positive pressure within the chamber such that the sheet can, respectively, be either drawn into contact with the surface of the sheet guide in the case of single sided printing, or "floated" above the surface of the sheet guide in the case of two sided printing (perfecting).

A disadvantage of the stationary sheet guide apparatus of the type described above is that, since the sheet is drawn onto and pulled against a substantially solid support surface, the non-printed surface of the sheet may be scratched as it slides over the surface. Furthermore, use of stationary sheet guides of the types described above can result in the sheet being pulled partially or fully from the transfer grippers due to the high frictional forces created between the sheet and the supporting surface of the guide.

A successful system which overcomes the limitations of stationary sheet guides is disclosed and claimed in U.S. Pat. Nos. 5,127,329, 5,133,255, 5,205,217, 5,228,391 and 5,243,909 to Howard W. DeMoore wherein a vacuum type sheet transfer apparatus is provided which engages and supports the non-printed side of a freshly printed sheet as it is transported from an impression cylinder of the press to the next printing unit. The DeMoore vacuum transfer apparatus includes an array of spaced apart support rollers disposed along the transfer path for engaging and supporting the non-printed side of a freshly printed sheet in such a manner that scratching of the non-printed side of the sheet does not occur, and precise sheet registration is maintained.

To insure a smooth transfer of sheets from the impression cylinder to the support rollers of the DeMoore vacuum transfer apparatus, it is important to position the apparatus as close to the impression cylinder as possible. Although mounting the vacuum transfer apparatus in this manner produces a smooth transfer of the sheets in many printing presses, proper sheet transfer is particularly difficult to achieve in some presses. Moreover, improper transfer of the sheets between the press impression cylinder and the vacuum transfer apparatus is particularly likely to occur during printing of lightweight stock, for example label stock. Label stock is usually not rigid enough to overcome the electrostatic forces present between the impression cylinder and the paper itself, thus label stock tends to stick to the impression cylinder as its leading edge is pulled through the vacuum transfer apparatus. When such electrostatic sticking or clinging occurs, the sheet tends to fold over and jam up in the transfer region between the impression cylinder and the vacuum transfer apparatus.

Another instance in which proper transfer of lightweight sheets is especially difficult to achieve occurs during the printing of so called "solids" wherein a relatively large portion of the printed side of the sheet receives wet ink from the blanket cylinder. This large solid printed area creates a tendency for the sheet to stick to the offset blanket. If the vacuum forces of the transfer apparatus are not sufficient to separate the lightweight sheets from the blanket cylinder, the sheet may be skewed or even ripped from the sheet grippers.

Still further, proper sheet transfer is also difficult to achieve when printing heavy board stock such as twenty-four point board. If the vacuum forces generated by the transfer apparatus are insufficient to overcome the stiffness of the board, the sheet will be slapped against the transfer cylinder or skeleton wheel, thereby resulting in marking and smearing of the printed side of the sheet.

OBJECTS OF THE INVENTION

A general object of this invention is to provide an air dam or seal between a vacuum type sheet transfer apparatus and an impression cylinder in an offset printing press to enable pressure differential or vacuum forces generated by the transfer apparatus to provide proper transfer of printed sheets in the press to prevent smearing the printed side or otherwise damaging the unprinted side of the sheet.

Another object of the invention is to provide an airflow seal that improves the movement of lightweight sheets from the impression cylinder as the lightweight sheets is pulled across a vacuum transfer apparatus.

Yet another object of the invention is to provide an air dam or seal device that operates to induce a partial vacuum in a region between a vacuum sheet transfer apparatus and an impression cylinder while also permitting sheet grippers on the impression cylinder to pass through the air dam or seal device.

Yet another object of the invention is to provide an air dam or seal device that induces vacuum forces in such a way that heavy board stock with so called printed solids are pulled along a proper sheet transfer path thereby avoiding marking or smearing of the printed side of the sheet.

Still another object of the present invention is to provide an arrangement of an air dam or seal device that is installed between a transfer cylinder and a vacuum transfer apparatus in a multi-color press to provide a partial seal between areas of different pressure in the press so that proper transfer of the printed sheets is obtained.

As will become more apparent hereinafter, the present invention provides a unique air dam or seal device operable for urging a freshly printed sheet along a proper transfer path between an impression cylinder and a vacuum transfer apparatus and achieving the foregoing objects in a novel and unobvious manner.

SUMMARY OF THE INVENTION

The present invention provides means forming a seal to air flow which may be characterized as an "air dam", for guiding freshly printed sheets along a proper transfer path between a printing press impression cylinder and a vacuum type sheet transfer apparatus.

In accordance with an important aspect of the invention an air flow seal or air dam is provided for support on the housing of a vacuum type sheet transfer apparatus and which extends from the housing in close proximity to the impression cylinder of a press. The air dam or seal controls the flow of air in the vicinity of the transfer apparatus in such a way as to improve the transfer of sheets from the impression cylinder to engagement with the support rollers of the vacuum transfer apparatus. In a preferred embodiment of the seal or air dam, a substantially rigid plate includes a base portion supported on the transfer apparatus housing and a generally upstanding wall portion terminating in a curved edge in close proximity to the surface of the press impression cylinder. Suitable openings are provided in the upstanding wall to permit movement of the impression cylinder gripper fingers past the air dam. The openings are normally sealed by flexible flaps which are momentarily deflected by the impression cylinder gripper fingers as the fingers pass through the plate.

In accordance with the invention, the seal or air dam device permits control of air flow in the vicinity of a vacuum transfer apparatus in those instances where the apparatus itself cannot be positioned sufficiently close to the impression or transfer cylinders of a press. In any event, the air dam device modifies the air flow in the vicinity of the impression cylinder in such a way that differential pressure or vacuum forces act on sheets of relatively lightweight stock as well as sheets of relatively stiff or heavy weight stock to provide precise transfer of the sheets.

The above-described features of the invention and the objects delineated for the invention together with other superior aspects will be further appreciated by those skilled in the art upon reading the detailed description which follows in conjunction with the drawing.

DETAILED DESCRIPTION OF PREFERRED EMBODIMENTS

Figure 1:
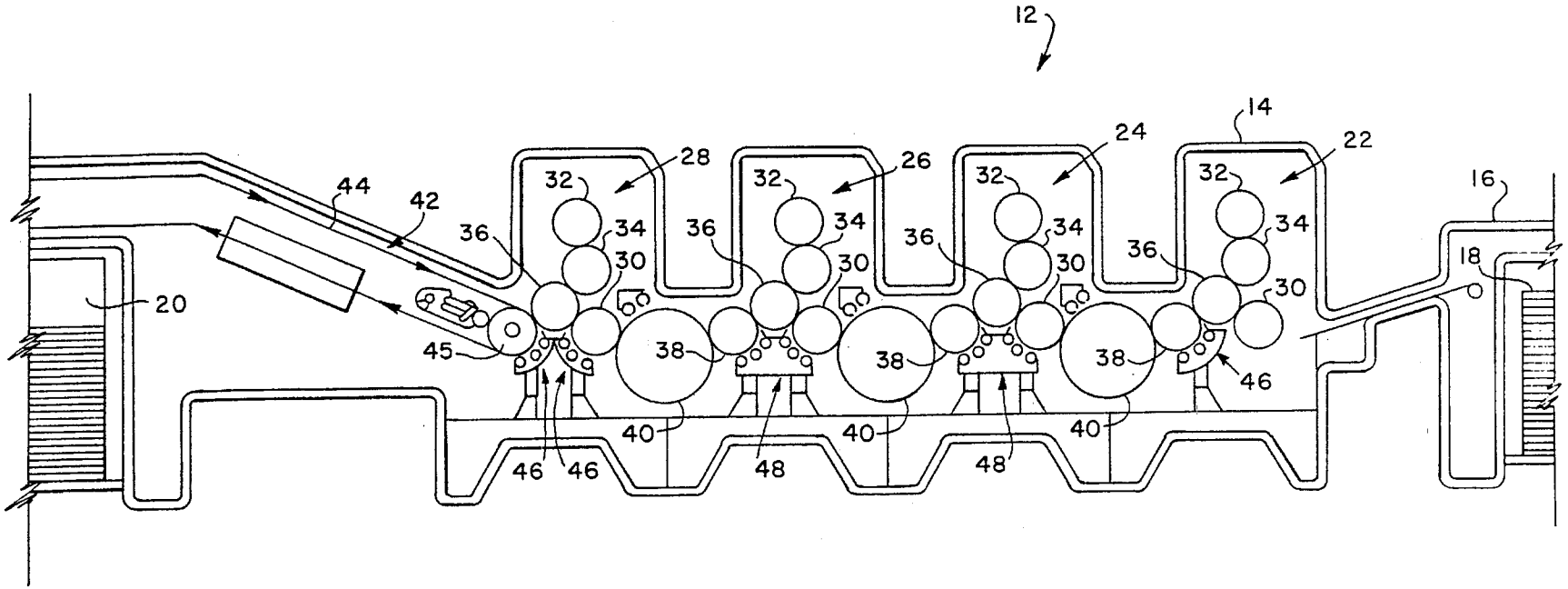
FIG. 1 is a side elevation, in substantially schematic form, of a rotary offset printing press which includes vacuum type transfer apparatus and the air dam or seal device of the present invention.

In the description which follows, like parts are marked throughout the specification and drawing with the same reference numerals, respectively. The drawing figures may not be to scale or show all features of conventional elements in the interest of clarity and conciseness.

Referring to FIG. 1, there is illustrated by way of example a four-color sheet-fed printing press, generally designated by the numeral 12. The press 12 may, for example, be of a type manufactured by Heidelberger Druckmaschinen AG of the Federal Republic of Germany and manufactured under the designation Heidelberg Speedmaster 102V (40"). The press 12 is characterized by a frame 14 connected at one end to a sheet feeder 16 of conventional construction from which suitable paper sheets 18 may be fed to the press for multiple printing operations to be performed thereon, respectively. The opposite end of the press 12 has a sheet receiving and stacking device 20, also of conventional construction, which receives the printed sheets after being processed by the press 12.

Interposed between the feeder 16 and the sheet delivery apparatus 20 are four substantially identical sheet printing units 22, 24, 26 and 28. The first printing unit 22 includes an in-feed transfer cylinder 30, a plate cylinder 32, a blanket cylinder 34, and an impression cylinder 36. The other printing units 24, 26 and 28 each include an interstation transfer cylinder 30, a plate cylinder 32, a blanket cylinder 34 and a rotatable transfer cylinder 38 disposed to guide the freshly printed sheets from the adjacent impression cylinder 36 and transfer the freshly printed sheets to the next printing unit by way of a further rotatable transfer cylinder 40. The impression cylinder 36 and delivery transfer cylinder 38 of the last printing unit 28 is operable to transfer the printed sheets to a delivery conveyor system 42 by way of conventional plural sheet gripper assemblies which are operably connected to endless chains 44.

Referring further to FIG. 1, the press 12 may be provided with vacuum-type sheet transfer apparatus operable to facilitate transfer of the freshly printed sheets from the respective impression cylinders 36. For example, at the printing unit 22 a vacuum type transfer apparatus 46 is provided for transferring sheets from the impression cylinder 36 to the transfer cylinder 38. At both printing units 24 and 26, a vacuum transfer apparatus 48 is provided for facilitating the transfer of sheets through the respective printing units. The last printing unit 28 may be provided with one of the vacuum-type transfer apparatus 48 or with back-to-back mounted vacuum transfer apparatus 46, as illustrated by way of example. For purposes of illustration, the vacuum transfer apparatus at unit 28, which transfers sheets 18 from the impression cylinder 36 of that unit to the delivery conveyor system 42, will be described in further detail in conjunction with FIG. 2 and the vacuum transfer apparatus 48 will also be described in further detail in conjunction with FIG. 6. The apparatus 46 and 48 are preferably of the types disclosed in U.S. Pat. Nos. 5,127,329, 5,133,255 and 5,205,217 to Howard W. DeMoore et al.

Figure 2:
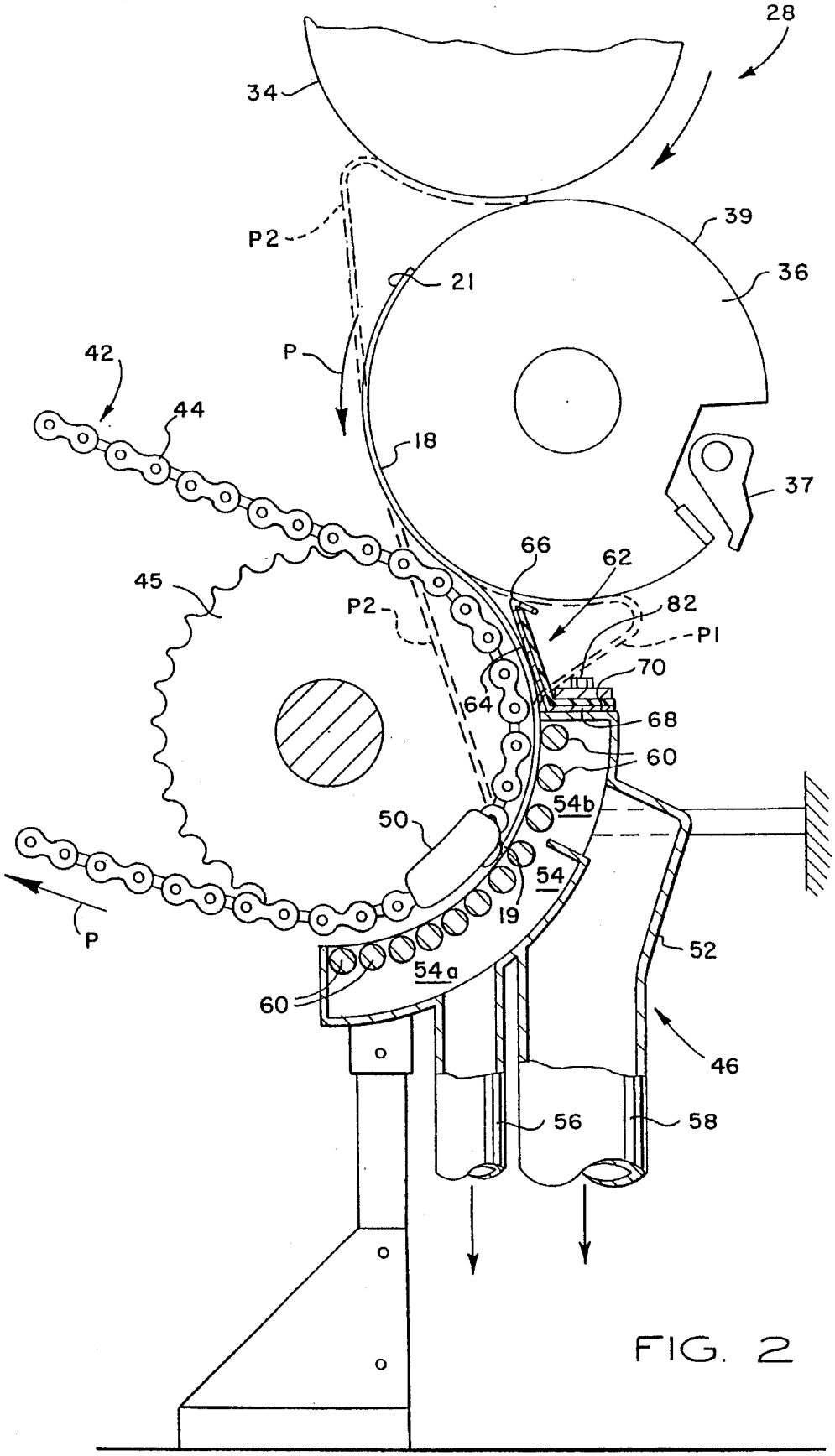
FIG. 2 is a detail view of the last printing unit of the press shown in FIG. 1 showing the vacuum type transfer apparatus and an air dam disposed in its working position adjacent the impression cylinder and the delivery conveyor system of the press.

Referring now to FIG. 2, the vacuum sheet transfer apparatus 46 is shown disposed adjacent to the sheet receiving end of the sheet delivery conveyor system 42 wherein a conveyor chain 44 is shown trained around a suitable drive sprocket 45. Conventional sheet gripper assemblies 50, one shown in FIG. 2, are operable to transfer sheets 18 from the surface of the impression cylinder 36 in a conventional manner. The gripper assembly 50 engages the leading edge 19 of a sheet 18 as respective gripper fingers 37 on the impression cylinder 36 release the sheet from engagement therewith in a conventional manner. As shown in FIG. 2 and described in further detail in the above-mentioned patents to DeMoore et al, the transfer apparatus 46 includes a manifold housing 52 defining a chamber 54 divided into segments **54*a* and 54*b* which are in communication with ducts 56 and 58**.

The ducts 56 and 58 are connected to a suitable vacuum source, not shown, for pulling air into the chamber 54 through spaces formed between a plurality of elongated generally cylindrical support rollers 60 which are arranged in an arcuate array, as illustrated in FIG. 2, and further described in detail in the DeMoore et al. patents. By generating at least a partial vacuum in the chamber 54, a sheet 18 is drawn into engagement with the support rollers 60 as the sheet is pulled away from the cylinder 36 and along the conveyor system 42 whereby the printed side 21 of the sheet is not required to engage a skeleton wheel or cylinder, not shown, of the conveyor system 42. In this way the sheet 18 may be maintained free of any marring or smearing of the freshly printed surface 21.

However, in many installations of the vacuum-type transfer apparatus 46 and 48 on commercial printing presses, the apparatus may not be placed in as close proximity to the cylinder 36 as might be desired for various reasons, including structural features of the press which interfere with placement of the apparatus any closer to the cylinder 36 than is illustrated in drawing FIG. 2, for example. One consequence of having the manifold housing 52 spaced some distance from the cylinder 36, or a similar sheet supporting cylinder, is that when printing relatively lightweight stock, for example, the sheet 18 may tend to stick to the surface of the impression cylinder 36 due to electrostatic forces acting therebetween. This tendency for the sheet to remain adhered to the surface of the cylinder 36 will sometimes cause the sheet to follow an unwanted transfer path as indicated by the dashed line P1 in FIG. 2. Path P1 may become so exaggerated that the sheet 18 will virtually fold onto itself causing contact between different portions of the printed surface 21, and the trailing edge of the sheet will be snapped back into the curvilinear path defined by the apparatus 46 with such force as to damage or tear the sheet.

Another problem wherein the sheet 18 refuses to follow the precise transfer path occurs during the printing of heavy concentrations or large areas of tacky ink on the sheet 21 (FIG. 2), sometimes referred to as printing solids. When printing solids a sheet 18 may tend to stick to the blanket cylinder 34 thus following a path P2 as the sheet is pulled tight and is reluctant to leave the surface of the blanket cylinder. Heavy-weight papers may also tend to follow that portion of path P2 adjacent to the leading edge 19, as shown in FIG. 2. Path P2 is also an unwanted transfer path and may result in tearing or improper registration of the sheets with respect to the gripper assembly 50.

It has been discovered in accordance with the present invention that the tendency for a sheet 18 to follow paths P1 or P2 may be substantially eliminated by the provision of a device, preferably disposed on the housing 52 of the vacuum transfer apparatus 46, in a position which reduces the clearance between the vacuum transfer apparatus and the surface of the cylinder 36, for example. As shown in FIG. 2 a unique seal or air dam device 62 is disposed between the apparatus 46 and the cylinder 36. The device 62 comprises an elongated, planar, substantially rigid plate member 64, see FIG. 3 also, extending between the housing 52 and the cylinder 36 and terminating at a curved edge 66.

The plate 64 includes a base portion 68 which is mounted on the housing 52 along a transverse surface 70 thereof. The curved upper edge 66 of the plate 64 is positioned close to the sheet supporting surface 39 of the impression cylinder 36. In this way, at least some of the air being drawn into the segment 54*b* of the chamber 54 is required to flow generally along the surface of the plate 64, between the plate and the chain 44, toward the air inlet spaces between the rollers 60. This flow of air aids in maintaining the sheet 18 moving along its precise path P as it transfers from the impression cylinder 36 to engagement with the support rollers 60 of the vacuum transfer apparatus 46.

The presence of the device 62 thus eliminates the tendency for the sheet 18 to follow the transfer path P1. Moreover, differential pressure acting on the surface 21 of the sheet 18 draws the sheet toward the plate 64 and thus eliminates the tendency for the sheet 18 to follow that portion of the path P2 between the cylinder 36 and the gripper assembly 50 as illustrated in FIG. 2. Accordingly, the sheet 18 is forced to follow the reverse curvilinear path P indicated by the solid lines depicting the sheet 18 as it travels from the impression cylinder 36 toward and across the support rollers 60 of the vacuum transfer apparatus 46.

Figures 3, 4, 5:
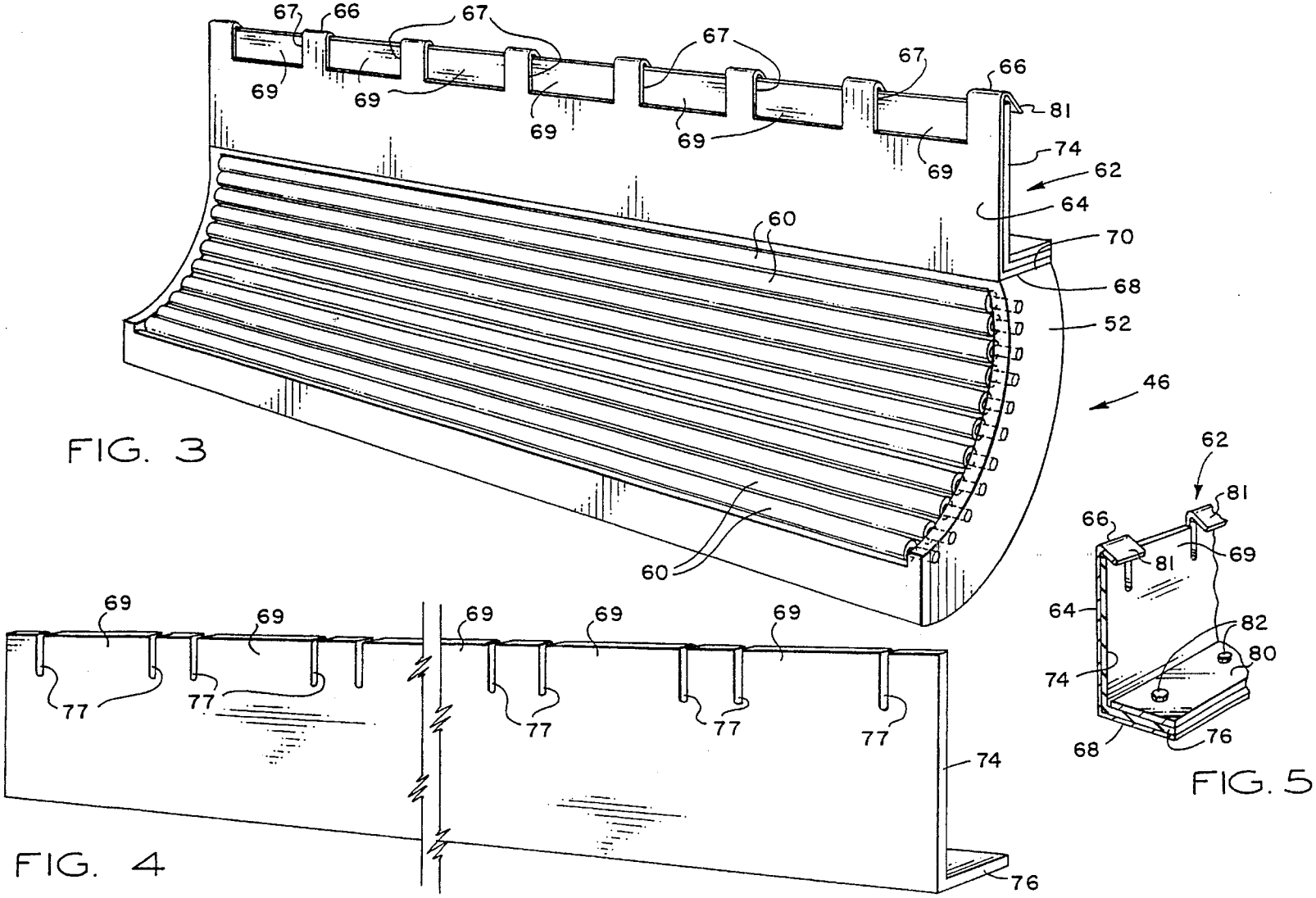
FIG. 3 is a perspective view of the housing of the vacuum transfer apparatus showing the air dam disposed thereon.
FIG. 4 is a perspective view of the flexible elastomer flap member of the air dam.
FIG. 5 is a perspective view showing certain features of the air dam type seal device.

Referring now to FIGS. 3 through 5, the air dam or seal device 62 is shown in further detail and disposed on the housing 52. As shown in FIG. 3, the plate 64 is provided with a plurality of spaced apart, generally rectangular openings 67 which intersect the upper curved edge 66. The openings 67 provide clearance for the gripper fingers 37 on the impression cylinder 36 so that the upper curved edge 66 of the air dam plate 64 may be positioned in very close proximity to the sheet support surface 39 of the impression cylinder. The openings 67 are occupied by respective flexible flaps 69, one being disposed across each opening as illustrated in FIG. 3. The flaps 69 are preferably formed on an elongated elastomeric sheet 74, FIG. 4, having a base portion 76 extending transversely from the plane of the relaxed position of the flaps 69. The flaps 69 are preferably formed by respective spaced apart slots 77. As shown in FIG. 5, the sheet 74 is secured in assembly with the plate 64 by a retainer plate 80 and by distal end tabs 81 on the plate 64 which are folded over to define the curved edge 66.

The air dam device 62 is secured to the housing 52 by suitable fasteners 82 which secure the plate 80, the elastomer member 74 and the plate 64 in assembly to the housing 52. Accordingly, the flaps 69 are operable to substantially prevent reduction of the effectiveness of the air dam type seal which would be caused by the presence of the openings 67 if these openings were allowed to be open at all times during rotation of the cylinder 36. However, with the provision of the resilient deflectable flaps 69, the impression cylinder gripper 37 may pass through the openings 67 with each revolution of the impression cylinder 36. The elastic memory of the flaps 69 causes them to return to their upright positions substantially blocking the openings provided by the recesses 67 during rotation of the impression cylinder 36 except when the gripper fingers pass the seal plate 64. Again, thanks to the provision of the air dam type seal device 62 the sheets 18 follow the desired path P from the impression cylinder 36 to the vacuum apparatus 46 and any tendency for the sheets to follow either path P1 or P2 is eliminated.

Figure 6:
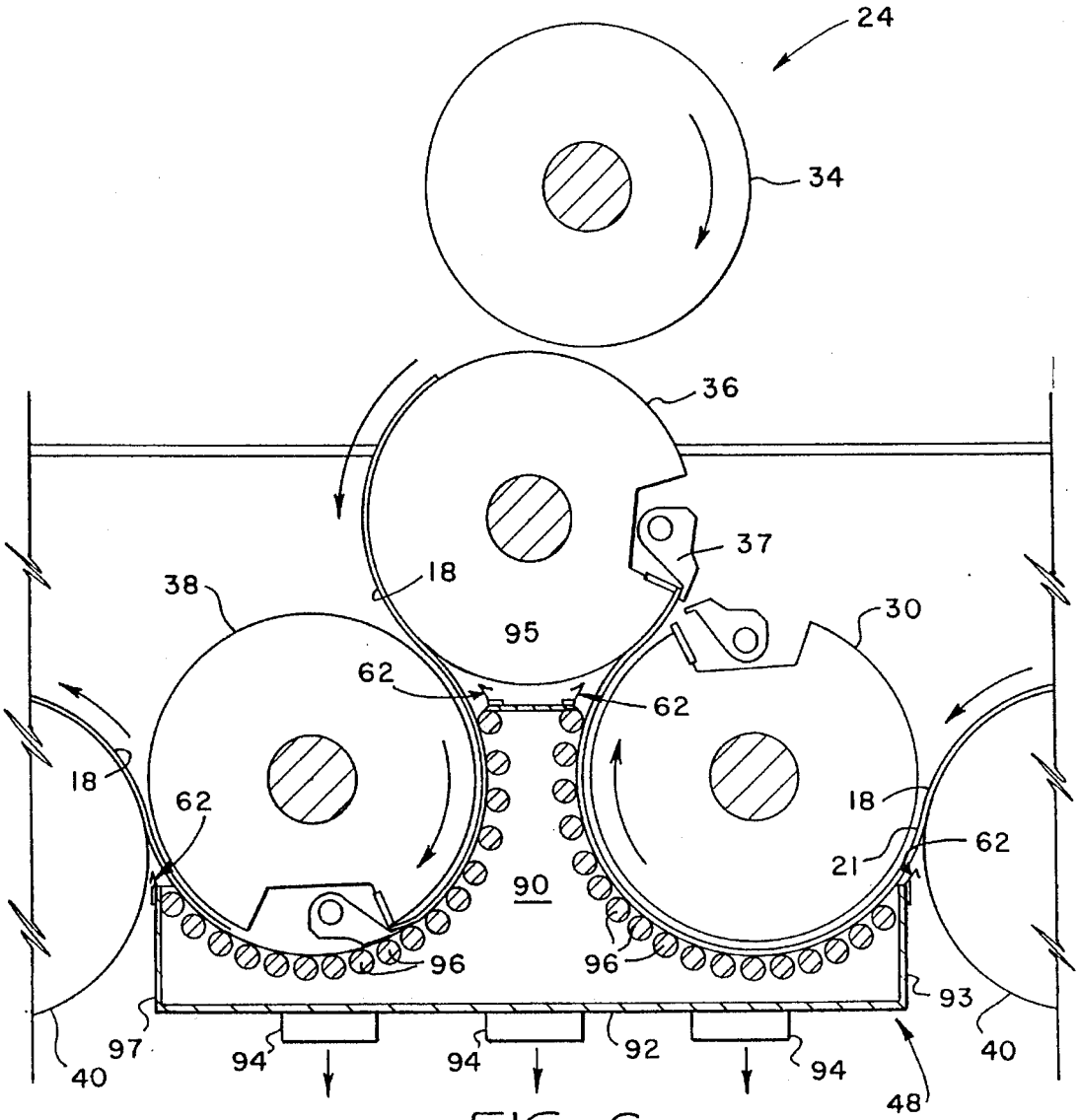
FIG. 6 is a view of a vacuum-type transfer apparatus in a multi-unit press showing the placement of plural air dam type seal devices thereon.

Referring now to FIG. 6, portions of the press printing unit 24 are illustrated by way of example, in somewhat schematic form, including an impression cylinder 36, a blanket cylinder 34, transfer cylinder 30 and a transfer cylinder 38. The transfer cylinder 30 is operable to transfer a sheet 18 from a transfer cylinder 40 to the impression cylinder 36 and the impression cylinder 36 is operable to transfer a sheet 18 to the transfer cylinder 38 for transfer to the next printing unit by way of an interstation transfer drum 40. As further shown in FIG. 6, the vacuum transfer apparatus 48 is shown in section so that a vacuum chamber 90 is illustrated. The chamber 90 is formed by a housing 92 having one or more air evacuation ducts 94 connected thereto and to a source of vacuum, not shown, whereby at least a partial vacuum is drawn within the chamber 90 to pull the sheets 18 around the arcuate path illustrated along path-defining surfaces provided by plural spaced apart support rollers 96.

The vacuum sheet transfer apparatus 48 operates in substantially the same manner as the apparatus 46 and the sheets 18 have the same tendencies to follow unwanted paths (P1 and P2) between the transfer drum 40 and the in-feed cylinder 30, between the cylinder 30 and the cylinder 36, between the cylinder 36 and the cylinder 38 and, finally, between the cylinder 38 and the transfer drum 40. However, by providing plural air dam devices 62 disposed in the positions shown in FIG. 6 any tendencies for the sheets to follow the unwanted transfer paths P1 and P2 are eliminated. The plates 64 of each device 62, in the operative positions shown in FIG. 6, may be bent to different angles from that shown in FIGS. 2 and 3.

As a sheet 18 is transferred from the cylinder 40 on the right side of FIG. 6 to the cylinder 30, an air dam device 62, disposed on a sidewall 93 of the housing 92, provides an effective seal for reducing the tendency for air to flow around the upper edge of sidewall 93 and into the chamber 90 and instead a differential pressure force acts on the surface 21 of the sheet 18 holding it in engagement with the support rollers 96. In like manner, the air dam seal 62 disposed adjacent the nip region of the cylinders 30 and 36 also functions to reduce the tendency for air to flow into the chamber 90 around the edge of a transverse top wall 95 of the apparatus 48. Instead a pressure differential or vacuum force acts on the sheet surface 21 to urge it against the support rollers 96. Still further, the devices 62 interposed between the cylinder 36 and the cylinder 38 and between the cylinder 38 and the second transfer cylinder 40 also reduce the tendency for air to flow around the other edge of the top wall 95 and the left sidewall 97 and into the chamber 90, respectively, so that the sheets 18 remain drawn into engagement with the array of the support rollers 96 during traversal of the sheets through the printing unit 24, for example.

The fabrication and operation of the device 62 is believed to be within the understanding of one skilled in the art from the foregoing description. The plate 64 may be fabricated of a conventional engineering material having sufficient rigidity to prevent deflection under differential pressure forces acting thereon as well as engagement with sheets 18 being fed through the press 12. The member 74 forming the flaps 69 may be made of a suitable elastomer, including natural or synthetic rubber, and having sufficient stiffness and elastic memory to provide for the flaps 69 to maintain the positions illustrated in FIGS. 3 and 4 but to be readily deflectable upon engagement with the gripper fingers 37, for example.

Although preferred embodiments of the invention have been described in detail herein, those skilled in the art will further recognize that various substitutions and modifications can be made to the embodiments illustrated and described without departing from the scope and spirit of the invention as set forth in the appended claims.

What is claimed is:

1. A device for use in a printing press in conjunction with a vacuum type sheet transfer apparatus wherein said sheet transfer apparatus includes a housing defining a chamber in which at least a partial vacuum is drawn and sheet support means defining a sheet support path for supporting sheets transferred along said transfer apparatus and urged into engagement with said sheet support means by a differential pressure force caused by said vacuum in said chamber, said device comprising:

a member extending between said housing and a sheet supporting cylinder of said press and operable to redirect the flow of air toward said chamber such that differential pressure forces acting on said sheet will cause said sheet to transfer from said cylinder to said sheet support means along a predetermined path.

2. The device set forth in claim 1 wherein:

said member comprises an elongated plate forming an air dam to reduce the flow of air into said chamber from between said housing and said cylinder and under a sheet being transferred to said sheet support means.

3. The device set forth in claim 2 wherein:

said plate includes a distal edge disposed in proximity to a surface of said cylinder and plural openings intersecting said edge and forming clearance spaces for movement of gripper fingers disposed on said cylinder past said device.

4. The device set forth in claim 3 including:

deflectable flap means disposed in said openings and engageable with said gripper fingers, respectively, for deflection to allow said gripper fingers to pass through said openings, said flap means being operable to minimize the flow of air between said cylinder and said plate.

5. The device set forth in claim 4 wherein:

said deflectable flap means comprise an elastomeric member supported on said plate.

6. The device set forth in claim 5 wherein:

said plate includes a plurality of spaced apart tabs defining said distal edge and engageable with said elastomeric member to retain said elastomeric member supported on said plate.

7. The device set forth in claim 1 including:

means for connecting said device to said housing for supporting said device between said housing and said cylinder.

8. The device set forth in claim 7 wherein:

said member comprises an elongated plate having a base portion adapted to be supported on said housing and a distal edge disposed adjacent to a surface of said cylinder and operable to substantially reduce air flow between said cylinder and said housing into said chamber.

9. The device set forth in claim 8 wherein:

said plate includes plural openings intersecting said distal edge and forming clearance spaces for movement of gripper fingers disposed on said cylinder past said device.

10. The device set forth in claim 9 including:

deflectable flap means interposed in said openings and engageable with said gripper fingers, respectively, for deflection to allow said gripper fingers to pass through said openings, said flap means being operable to minimize airflow between said cylinder and said plate.

11. A device for use in a printing press in conjunction with a vacuum-type sheet transfer apparatus wherein said sheet transfer apparatus includes a housing defining a chamber in which at least a partial vacuum is drawn and sheet support means defining a sheet support path for supporting sheets transferred along said transfer apparatus wherein said sheets are urged into engagement with said sheet support means by differential pressure caused by said vacuum in said chamber, said device comprising:

an elongated plate supported on said housing and extending generally between said housing and a sheet supporting cylinder of said press for redirecting the flow of air flowing toward said chamber such that said differential pressure force acting on said sheet will cause said sheet to transfer from said cylinder to said sheet support means along a predetermined path, said plate including a distal edge disposed in proximity to a surface of said cylinder and plural recesses formed in said plate and intersecting said edge and defining clearance spaces for movement of sheet gripper fingers disposed on said cylinder past said device.

12. The device set forth in claim 11 including:

deflectable flap means disposed in said openings and engageable with said gripper fingers, respectively, for deflection to allow said gripper fingers to pass through said openings, said flap means being operable to minimize the flow of air between said cylinder and said plate and into said chamber.

13. The device set forth in claim 12 wherein:

said plate includes a base portion adapted to be supported on said housing and said flap means comprises an elongated elastomeric member defining said flap means, respectively.

14. The device set forth in claim 13 including:

means for securing said plate and said elastomeric member to said housing.

15. In a vacuum transfer apparatus for a printing press, said apparatus including a housing defining a chamber in which at least a partial vacuum is drawn and support roller means defining a sheet transfer path in said printing press and delimiting at least part of said chamber, the improvement characterized by:

at least one air dam device associated with said apparatus and extending between said housing and a sheet transfer cylinder of said press and operable to minimize the flow of air between said cylinder and said housing in such a way that differential pressure forces are operable to act on said sheet to urge said sheet into engagement with said support roller means as said sheet passes along said transfer path.

16. The invention set forth in claim 15 wherein:

said transfer apparatus includes a first array of support roller means disposed adjacent the periphery of said sheet transfer cylinder, and said apparatus includes a second air dam device disposed on said housing and operable to minimize the flow of air between said housing and further sheet transfer means on said press to cause differential pressure forces to act on said sheet to urge said sheet into engagement with said support roller means.

17. The invention set forth in claim 16 wherein:

said apparatus is disposed at a printing unit of said press and includes plural arrays of support roller means for supporting said sheets for transfer to an impression cylinder of said press and from an impression cylinder of said press, and said housing includes third and fourth air dam devices interposed between said housing and said impression cylinder for redirecting the flow of air to urge said sheets to engage said support roller means as said sheets approach said impression cylinder and as said sheets leave said impression cylinder, respectively.

18. The invention set forth in claim 15 wherein:

said air dam device includes a member comprising an elongated plate forming an air dam to reduce the flow of air into said chamber from between said housing and said cylinder and under a sheet being transferred to said support rollers.

19. The invention set forth in claim 18 wherein:

said plate includes a distal edge disposed in proximity to a surface of said cylinder and plural openings intersecting said edge and forming clearance spaces for movement of gripper fingers disposed on said cylinder past said device.

20. The invention set forth in claim 19 including:

deflectable flap means disposed in said openings and engageable with said gripper arms, respectively, for deflection to allow said gripper arms to pass through said openings, said flap means being operable to minimize the flow of air through said openings.

* * * * *